US008058816B2

(12) United States Patent
Sejkora

(10) Patent No.: US 8,058,816 B2
(45) Date of Patent: Nov. 15, 2011

(54) COLOUR TEMPERATURE AND COLOUR LOCATION CONTROL FOR A LIGHT

(75) Inventor: Gunther Sejkora, Schwarzenberg (AT)

(73) Assignee: Ledon Lighting GmbH (AT)

( * ) Notice: Subject to any disclaimer, the term of this patent is extended or adjusted under 35 U.S.C. 154(b) by 428 days.

(21) Appl. No.: 12/296,149

(22) PCT Filed: Mar. 30, 2007

(86) PCT No.: PCT/EP2007/002879

§ 371 (c)(1),
(2), (4) Date: Jan. 14, 2009

(87) PCT Pub. No.: WO2007/115706

PCT Pub. Date: Oct. 18, 2007

(65) Prior Publication Data

US 2009/0174332 A1 Jul. 9, 2009

(30) Foreign Application Priority Data

Apr. 7, 2006 (DE) ..... 10 2006 016 513
Nov. 24, 2006 (DE) ..... 10 2006 055 615

(51) Int. Cl.
*H05B 37/02* (2006.01)
*F21V 21/30* (2006.01)

(52) U.S. Cl. ..... 315/291; 315/152; 315/297; 362/287; 362/84

(58) Field of Classification Search ..... 315/152, 315/297, 291, 160; 313/498–512; 362/84, 362/231, 287, 293, 296.1
See application file for complete search history.

(56) References Cited

U.S. PATENT DOCUMENTS

| | | | | |
|---|---|---|---|---|
| 5,350,977 | A * | 9/1994 | Hamamoto et al. | 315/291 |
| 6,498,440 | B2 * | 12/2002 | Stam et al. | 315/291 |
| 6,523,976 | B1 * | 2/2003 | Turnbull et al. | 362/231 |
| 6,552,495 | B1 * | 4/2003 | Chang | 315/169.3 |
| 7,125,143 | B2 * | 10/2006 | Hacker | 362/231 |
| 7,140,752 | B2 * | 11/2006 | Ashdown | 362/276 |
| 7,524,097 | B2 * | 4/2009 | Turnbull et al. | 362/545 |
| 7,687,753 | B2 * | 3/2010 | Ashdown | 250/205 |
| 7,759,854 | B2 * | 7/2010 | Miller et al. | 313/498 |

FOREIGN PATENT DOCUMENTS

| | | |
|---|---|---|
| EP | 0574993 | 12/1993 |
| WO | 2006001221 | 1/2005 |
| WO | 2006103600 | 10/2006 |

OTHER PUBLICATIONS

International Search Report PCT/EP2007/002879; Dated Jul. 31, 2007.

* cited by examiner

*Primary Examiner* — Vibol Tan
(74) *Attorney, Agent, or Firm* — Cantor Colburn LLP

(57) ABSTRACT

The present invention relates to a method for providing control signals for a light whose color or color temperature is variable. The invention also relates to a corresponding control apparatus and a corresponding lighting system. In the method, a series of at least three color locations ($F_1$, $F_2$, $F_3$) is determined, which lie on a predetermined color change curve (K1) in a corresponding coordinate system. By way of example, the color change curve may be the Planck curve train or a straight line. The color locations ($F_1$, $F_2$, $F_3$) are in this case chosen such that the respectively corresponding colors have a color distance (d) which, at least approximately, is subjectively perceived as in each case being of the same magnitude. This makes it easier to adjust the light to give a specific desired light impression.

17 Claims, 5 Drawing Sheets

COLOUR TEMPERATURE AND COLOUR LOCATION CONTROL FOR A LIGHT

TECHNICAL FIELD OF THE INVENTION

This invention concerns a method of providing control signals for a luminaire whose colour or colour temperature can change. The invention also concerns a corresponding control device and a corresponding lighting system.

BRIEF DISCUSSION OF RELATED ART

In general, a light source radiates light which is not monochromatic, but has a more or less wide wavelength spectrum. Therefore, in general, the colour of this light cannot be described, or can be described only inadequately, by giving only one wavelength.

One possibility for indicating the colour of the light at least approximately and comparatively easily is to give the temperature which a black body would have to have to emit light of a colour which is equal to the colour to be described of the light source, or at least comes as close to it as possible. This temperature is usually called the "colour temperature" or "most similar colour temperature".

For quantitative description of colours, certain two-dimensional or three-dimensional co-ordinate systems are normally used. For instance, for this purpose the known "CIE standard colour table" according to CIE 1931, DIN 5033 is used (CIE: Commision Internationale de l'Eclairage; in English: International Commission on Lighting). Other examples of this are the so-called "CIE LAB colour space" or the "CIE LCH colour space". In such a co-ordinate system, a "colour location", which identifies a particular colour, can be defined using the co-ordinates.

In FIG. 2, in very schematic and simplified form (necessarily represented in black and white), the above-mentioned standard colour table according to CIE 1931 is shown. In this diagram, the co-ordinates are usually identified as x and y. A point (x, y) in the diagram thus indicates a colour location which identifies a particular colour. The monochromatic colours lie along an approximately horseshoe-shaped border area, the "spectral train line". At some points of this border area, as shown in FIG. 2, the corresponding values of the associated wavelengths are entered in nanometre (nm) units. The so-called "white point" has the co-ordinates x=0.33 and y=0.33.

It should be noted in this context that a colour involves a sensory impression, which is subject to individual assessment. A particular colour cannot therefore be uniquely defined in the mathematical sense. So that colour can nevertheless be quantitatively described, the usual systems of colour description are based on an "average colour perception", defined using extensive trials, of a "standard observer" (see "CIE standard observer" of 1931 and 1964).

From the prior art, luminaires which radiate light of a specified colour temperature are known. Such luminaires are also known with the possibility of adjusting the colour temperature in stages. In the case of these luminaires according to the prior art, the adjustment stages are chosen so that the differences from one stage to the adjacent stage each correspond to a specified difference in the colour temperature.

When such a luminaire is adjusted over several adjustment stages, the light impression, i.e. the (at least primary) visual impression which the light makes on the observer, does change; however, the change is not proportional to the adjustment stages. It can therefore happen, for instance, that an operator, on an adjustment from the first stage to the second stage, perceives a clear difference in the impression which the light communicates, but on a further adjustment to the third stage, perceives a noticeably slighter difference, or possibly no difference at all, in the light impression. With such a luminaire, it is therefore not easily possible to generate a light which communicates a particular desired light impression by corresponding adjustment. In general, such adjustment is also relatively time-consuming.

Additionally, from the prior art, luminaires with which—independently of the colour temperature—light can be radiated in different colours are known. Usually, these luminaires have three different light sources, with each of which light of a specified colour can be generated. The brightnesses of the three light sources can be adjusted independently of each other, so that a corresponding mixture can be generated. In this way, light of different colours can be generated with the luminaire. In general, the three colours of the three light sources can be given in the standard colour table (see FIG. 2) as three colour locations, which span a triangle in the underlying co-ordinate system. By the stated mixture of the three light sources, in principle, in known manner, a light of any colour whose colour location is within this triangle can be generated.

BRIEF SUMMARY OF THE INVENTION

This invention is directed toward giving a control of a luminaire, a corresponding control device and a corresponding lighting system, with which adjustment to a specified desired light impression is made easier.

According to a first aspect of the invention, a method of providing control signals for a luminaire which can radiate light in different colours is provided. The method has the following steps a) and b): a) depending on a first colour location, which identifies a first colour, and a second colour location, which identifies a second colour, which differs from the first colour—and subject to the two conditions i) and ii) below—a colour location which is to be determined, and which identifies a further colour, is determined. The first condition i) is: the colour location to be determined, in a co-ordinate system which represents the colour locations, together with the first and second colour locations, is at least approximately on a specified colour change curve. The second condition ii) is: the colour distance between the first and second colours, or an integer multiple of this colour distance, at least approximately equals the colour distance between the first and further colours or between the second and further colours. The method also includes the following step: b) on the basis of the determined colour location, a control signal which causes the luminaire to radiate light in the further colour corresponding to the determined colour location is generated.

"Colour distance" here means a subjectively perceived difference between two colours, in particular between a first colour of a first light and a second colour of a second light. Since, as mentioned, colour perception is subject to individual assessment, it is difficult, and in the end impossible, to give an "exact" objective measure for the perception of a difference between two colours. In this context, therefore, "colour distance" means the subjectively perceived difference between two colours which is given on the basis of a "standard colour vision", as it can be defined, for instance, using a standard observer.

Against this background, the formulation "at least approximately equal to the colour distance" should be understood to mean that on the basis of a "standard colour vision", an imprecision representing a measure of a permitted difference from the exact value can be defined. For instance, a corresponding indication in a so-called "equidistant" colour system is suitable for this. Something similar applies to the formulation "at least approximately on a specified colour change curve".

The "colour change curve" is, so to speak, a path in the corresponding co-ordinate system, and in general does not necessarily represent a curve in the mathematical sense. Instead, it is a specified curved or straight line in the co-ordinate system.

According to a second aspect of the invention, a method of providing control signals for a luminaire which can radiate light in different colours is provided. The method has the following steps a) and b): a) depending on a first colour location, which identifies a first colour, and a specified colour distance—and subject to the two conditions i) and ii) below—a colour location which is to be determined, and which identifies a further colour, is determined. The first condition i) is: the colour location to be determined, in a co-ordinate system which represents the colour locations, together with the first colour location, is at least approximately on a specified colour change curve. The second condition ii) is: the colour distance between the first and further colours at least approximately equals the specified colour distance or an integer multiple of it. The method also includes the following step: b) on the basis of the determined colour location, a control signal which causes the luminaire to radiate light in the further colour corresponding to the determined colour location is generated.

With a method according to the first or second aspect of the invention, it becomes possible, using an appropriate luminaire, to generate "lights" in multiple different, discrete colours (therefore meaning a first light of a first colour, a second light of a second colour, etc.), in such a way that the differences between these colours are perceived as equidistant or at least approximately equidistant. Each stage between two adjacent colours in the meaning of the colour change curve corresponds to a particular colour distance, which is equally great in each case, and thus to an equally great difference between the impressions which the differently coloured lights evoke in an observer.

For instance, the specified colour change curve can be the Planckian locus. Preferably in this case, the luminaire comprises three lamps, preferably LEDs or fluorescent lamps, which can emit light of different colours. The three colours can be colours whose corresponding colour locations in the co-ordinate system span a triangle, which for instance in the case of the standard colour table 1931 or a corresponding co-ordinate system surrounds the white point. It can also be provided that the colour change curve runs through the white point or through a "white area"; "white area" here means a (small) area which surrounds the white point, and in which—again on the basis of standard colour vision—with respect to the colour impression, the impression of "white" predominates. A colour change curve which—apart from a change of direction in the "white area"—runs in a straight line can be provided. In this way, the effect that a luminaire can be controlled so that it radiates light in a first colour, this colour graduates in equal steps more and more into white, and finally graduates in further equal steps into a different, second colour (which in principle can be any colour), can be achieved.

In a further embodiment, the specified colour change curve can be a straight line. In this case, the luminaire advantageously has at least two lamps, preferably LEDs or fluorescent lamps, which can emit light in different colours. In this case, in principle (only) two lamps are required, provided that the colour change curve is chosen so that these two lamps can emit light in two colours, the corresponding colour locations of which are on the colour change curve. By correspondingly differently weighted brightness control, light can then be generated in every colour whose colour location is on this colour change curve.

Also, preferably, in a step in the method according to the invention, a series of at least three colour locations is defined, such that, for their three corresponding colours, between any two colours which are adjacent according to the colour change curve, at least approximately an equally great colour distance is present.

Advantageously, in this case, the luminaire is controlled temporally so that the at least approximately equally great colour distances are passed through at least approximately equal time intervals. In this way, adjustment is made even easier.

Advantageously, as the co-ordinate system, a co-ordinate system in which a geometrical distance between two colour locations at least approximately represents a measure for a specified colour distance, e.g. a so-called "equidistant" colour system, is chosen. For instance, for this purpose the representation of the "CIE 1976 colour table" can be chosen as the co-ordinate system.

According to a further aspect of the invention, a control device to provide control signals for a luminaire, the colour of which is changeable, is provided. The control device comprises a) an input unit for input of input quantities, and b) a computation unit for determining a series of at least three colour locations, which identify three different colours, depending on the input quantities, the colour locations being chosen so that, in a co-ordinate system which represents the latter, they are at least approximately on a specified colour change curve, and that between any two colours which are adjacent according to the colour change curve, at least approximately equally great colour distances are present, and for determining, for the luminaire, control signals using which the luminaire can be caused to radiate light in the at least three colours (so what this means is radiation of a first light of a first colour, a second light of a second colour and a third light of a third colour, and these three "lights" do not overlap in time). The control device also includes c) a transmission unit to transmit the control signals to the luminaire.

Advantageously, the input quantities are either two colour locations which differ from each other or one colour location and one colour distance.

Advantageously, the computation unit is designed to use a method according to the invention to determine the control signals.

According to another aspect of the invention, a lighting system which has a control device according to the invention is provided, the control device being connected to a luminaire whose colour is changeable.

According to another aspect of the invention, a method of providing control signals for a luminaire whose colour temperature is changeable is provided. The method has the following step: determination of a colour temperature setpoint value depending on two specified colour temperature values which differ from each other, the colour temperature setpoint value being chosen so that the colour distance between the two colours, which correspond to the specified colour temperature values, or an integer multiple of this colour distance, at least approximately equals the colour distance between the colour which corresponds to one of the two specified colour temperature values and the colour which corresponds to the colour temperature setpoint value to be determined.

In this method, therefore, a colour temperature setpoint value is defined depending on two different specified colour temperature values (colour temperatures for short). Using this method, it becomes possible to set different lighting types with a luminaire, the lighting types differing in their colour temperature, in such a way that the differences between the lighting types are perceived as equidistant or at least approximately equidistant with respect to their colour. Thus a specified colour distance, which is equally great in each case, and therefore an equally great difference between the impressions which the two corresponding lighting types evoke in an observer, corresponds to each stage.

According to this aspect, the invention uses the recognition that a specified difference between two different colour temperatures is not a measure of the difference of light impression which goes with it. A suitable measure of it is the so-called colour distance of the light.

According to another aspect of the invention, a method of providing control signals for a luminaire whose colour temperature is changeable is provided. The method has the following step: determination of a colour temperature setpoint value depending on a specified colour temperature value and a specified colour distance, the colour temperature setpoint value being chosen so that the colour distance between the colour which corresponds to the specified colour temperature value and the colour which corresponds to the colour temperature setpoint value to be determined at least approximately equals the specified colour distance or an integer multiple of the specified colour distance.

Advantageously, the luminaire includes three lamps, which can emit light in different colours. In particular, the three colours can be three colours which when combined or mixed give white. For instance, they can be the colours red, green and blue.

Advantageously, the three lamps are LEDs or fluorescent lamps.

Advantageously, in a further step, a series of at least three colour temperature values, for the three corresponding colours of which it is the case that between any two adjacent colours, an at least approximately equal colour distance is present, is defined. In this context, let "corresponding colour" be understood as that colour in which a black body at the corresponding temperature emits light. For instance, a colorimetry based on a defined "standard colour vision" can be used as a basis.

For a specified interval of colour temperature values, the associated colour locations in the standard colour table in each case can be calculated. If these colour locations are entered in the x, y diagram of the standard colour table, the result is the so-called Planckian locus. This is shown schematically in FIG. 2. At some points, the appropriate colour temperature values are entered as examples. The expression "adjacent" colours is intended to express that these colours are adjacent on the Planckian locus.

Therefore, for instance, if the colour temperature setpoint value is determined in dependences on two specified colour temperature values $T_1$ and $T_2$, where $T_2>T_1$, a series of three colour temperature values can be defined, the two specified colour temperature values representing the first two values of this series and the determined colour temperature setpoint value TS representing the third value $T_3$ of the series. In this case, the colour temperature setpoint value TS can be determined either by the colour distance corresponding to the colour distance between $T_1$ and $T_2$ being chosen directly as the colour distance between TS and $T_2$, or by the colour distance between TS and $T_1$ corresponding to twice the value of this colour distance.

In principle, by suitable choice of the number of colour temperature values, both the gradation precision and the range which is adjustable as a whole can be defined as precisely as desired.

Advantageously, the relationship between two colour temperature values and the colour distance between the two colours corresponding to the two colour temperature values is determined with the aid of Planck's radiation law and the for instance standardised sensitivities of the human eye to red, green and blue light. Also, a colour co-ordinate system in which a geometrical distance between two colour locations at least approximately represents a measure of a specified colour distance value (colour distance for short) is used. For instance, for this purpose a colour co-ordinate system based on "standard colour vision" can be chosen for this purpose. Such a colour system is called "equidistant" here.

Advantageously, as the colour co-ordinate system the diagram representation of the CIE 1976 colour table is used.

Then, in a further step, in a way which is known per se, control signals, with which the luminaire can be controlled in such a way that it radiates light of the corresponding colour temperature in each case, can be formed from the colour temperature values of the defined series.

According to another aspect of the invention, a method of changing the colour temperature of white light in stages is provided, all white light values in the two-dimensional colour diagram (standard colour table) according to CIE 1931, DIN 5033 lying on the Planck locus or in its immediate vicinity. In this case the co-ordinate system of the colour diagram is transformed into a different co-ordinate system, the distinguishing feature of which is that the colour distances between any two colour locations of the same geometrical distance are perceived subjectively as roughly equivalent jumps.

Advantageously, the colour tones of the same geometrical distance on the Planckian locus in the other co-ordinate system are determined—starting from a first colour location—by drawing a circle, which defines the distance, and the intersection points of which with the Planckian locus give two further colour locations, around it.

According to another aspect of the invention, a control device is provided for providing control signals for a luminaire whose colour temperature is changeable. The control device comprises an input unit for input of input quantities, a computation unit for determining a series of at least three colour temperature values, depending on the input quantities, the colour temperature values being chosen so that they correspond to three colours in such a way that between any two adjacent colours, an at least approximately equally great colour distance is present, and for determining, for the luminaire, control signals using which the luminaire can be caused to radiate light with the at least three colour temperature values, and a transmission unit to transmit the control signals to the luminaire.

Advantageously, as input quantities, either two colour temperature values which differ from each other are used, or one colour temperature value and one colour distance value.

Advantageously, the computation unit of the control device is designed to use a method according to the invention to determine the control signals.

According to another aspect of the invention there is provided a lighting system which has a control device according to the invention, the control device being connected to a luminaire whose colour temperature is changeable.

According to another aspect of the invention there is provided an arrangement for changing the colour temperature of white light, which is generated by mixing coloured light of the colours red, green and blue, in stages. The An arrangement comprises at least three lamps, of which each generates light of one of the three named colours, and a control device, which is connected to the lamps and generates separate control signals for them, corresponding to the change stages. The control signals which the control device generates are such that the colour distance of the generated white light is always at least approximately equal from one stage to the next.

BRIEF DESCRIPTION OF THE DRAWINGS

Other features, advantages and properties will now be explained on the basis of a detailed description of embodiments, and the attached drawings will be explained with reference to the figures.

DETAILED DESCRIPTION OF THE INVENTION

Figure 1:
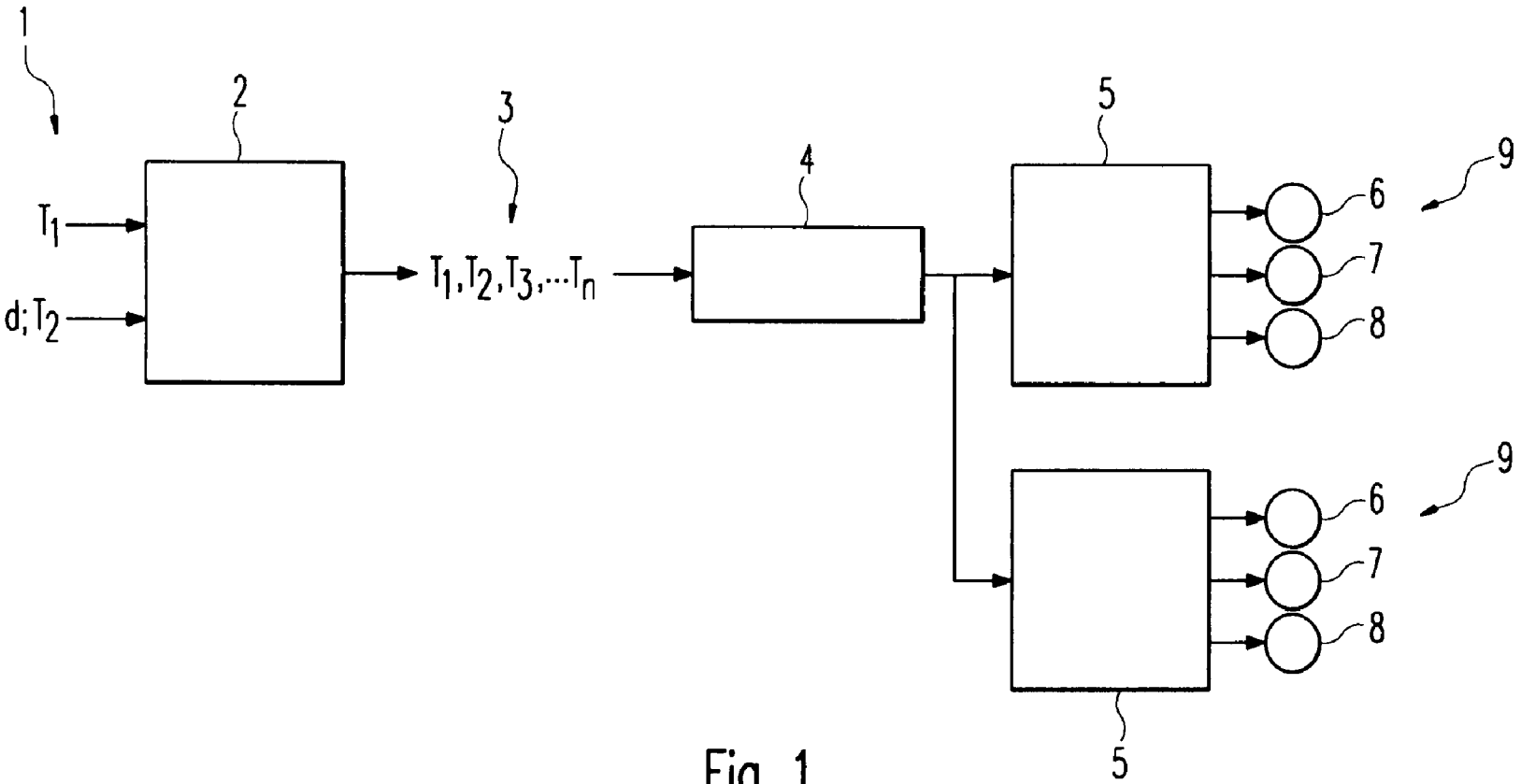
FIG. 1 shows a schematic representation of a lighting system according to the invention.
Figure 2:
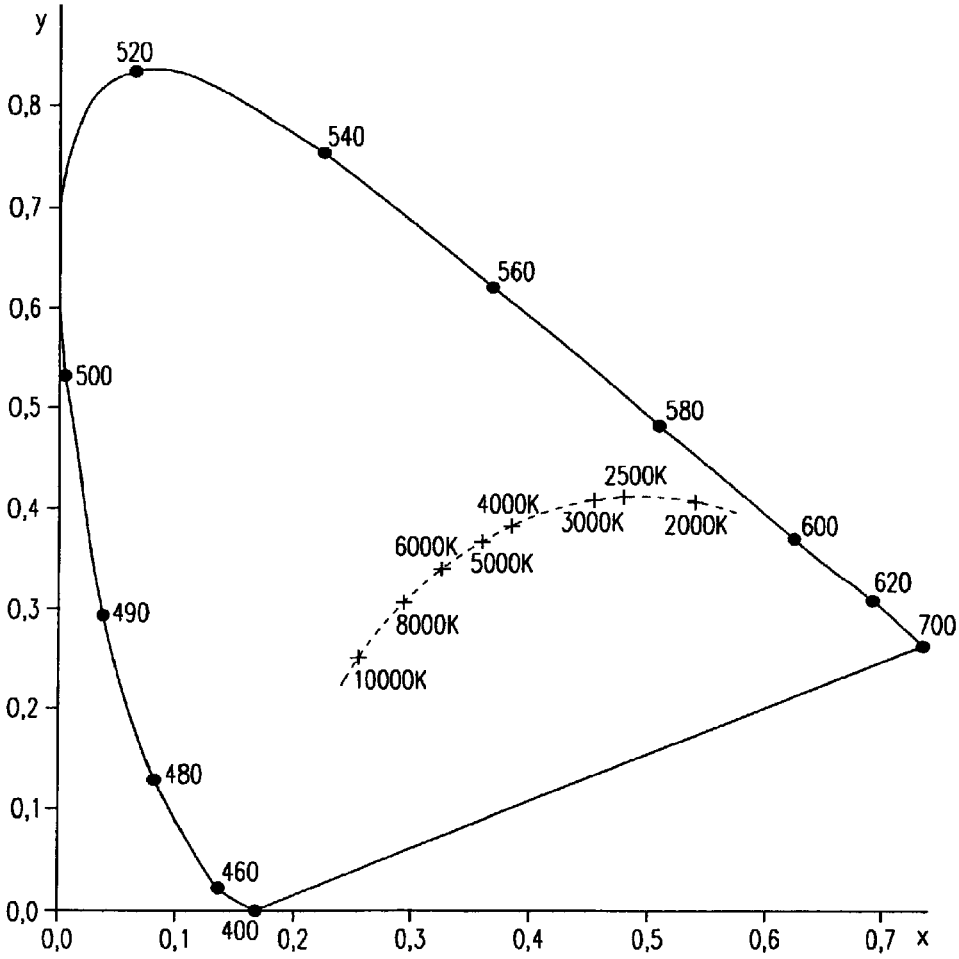
Fig. 2 PRIOR ART
FIG. 2 shows a simplified representation of the standard colour table according to CIE 1931.

This invention concerns, according to a first embodiment, the control of a luminaire, with which light of different colour temperatures can be generated. In FIG. 1, an example of a lighting system according to the invention, which is suitable for carrying out the method according to the first embodiment, is sketched very schematically.

The lighting system comprises a controller 2 with a control device, a control line 4, and at least one lamp operating device 5 with three lamps 6, 7, 8, which represent part of a luminaire 9. The lamps 6, 7, 8, in combination with each other, are designed to generate light at a specified colour temperature. For this purpose, as lamps 6, 7, 8, for instance three light-emitting diodes (LEDs) can be used, each of the LEDs being able to radiate light of a different colour, so that by suitable combination, the result is white light of a particular colour temperature. For instance, as the colours for this, red, blue and green can be chosen.

However, it is also possible to provide a different type of lamps 6, 7, 8, e.g. three fluorescent lamps, with which—e.g. using colour filters—light in the appropriate colours can be generated.

Using the controller 2, control signals with which the luminaire 9 can be controlled so that it generates light of a specified colour temperature can be generated.

The control device of the controller 2 includes an input unit for input of input quantities 1. In particular, the input quantities 1 can be colour temperature values $T_1$, $T_2$, and/or a colour distance value (colour distance for short) d. The control device also includes a computation unit, with which a series of at least three colour temperature values $T_1$, $T_2$, $T_3$ can be calculated. This calculation is explained in more detail below. The computation unit is also designed to determine, as output quantities, control signals suitable for controlling the at least one luminaire 9 so that it generates light with the at least three colour temperature values $T_1$, $T_2$, $T_3$. The control device also includes a transmission unit to transmit the control signals to the luminaire 9.

For the lighting system, for instance two or more such luminaires 9 can be provided.

The control signals are used, in a way which is known per se, to control the at least one luminaire 9. The control line 4 can be part of a bus system, which can be based on the DALI (digital addressable lighting interface) technology, for instance. In the lamp operating device 5, from the digital signal which represents a particular colour temperature value, the corresponding manipulated variable for the luminaire 9 and/or the three lamps 6, 7, 8 is generated.

Below, the central element of the invention, which is to be seen in the field of the calculation of the at least three colour temperature values $T_1$, $T_2$, $T_3$, is explained in more detail. For this purpose, two embodiments are given below:

According to a first embodiment, it is provided that as input quantities 1, two different colour temperature values $T_1$ and $T_2$ are chosen. Next, from $T_1$ and $T_2$, using Planck's radiation law, the two intensity distributions $I_1(\lambda)$ and $I_2(\lambda)$, corresponding to the corresponding black body radiations in each case, are determined depending on the wavelength $\lambda$. $I_1(\lambda)$ therefore designates the intensity distribution of the radiation which a black body at temperature $T_1$ emits, and $I_2(\lambda)$ designates that of a black body at temperature $T_2$. The intensity distribution $I(\lambda)$ of the radiation of a black body can be given as follows, generally formulated in known manner by Planck's radiation law, depending on the temperature T:

$$I(\lambda) = \frac{2\hbar c^2}{\lambda^5} \frac{1}{e^{\frac{\hbar c}{\lambda k T}} - 1} \tag{1}$$

where h represents Planck's quantum of action, c represents the speed of light, and k represents Boltzmann's constant.

In a next step, the colour impression which is evoked in the case of a human being with normal colour vision on observing the visible part of the radiation with intensity distribution $I_1(\lambda)$ is determined. The same procedure is carried out for $I_2(\lambda)$. For this purpose, generally formulated, first the intensity distribution $I(\lambda)$ is weighted as follows with the sensitivities of the human eye for red, green and blue light $\bar{x}$,$\bar{y}$,$\bar{z}$:

$$X=\int I(\lambda)\cdot\bar{x}(\lambda)d\lambda \tag{2}$$

$$Y=\int I(\lambda)\cdot\bar{y}(\lambda)d\lambda \tag{3}$$

$$Z=\int I(\lambda)\cdot\bar{z}(\lambda)d\lambda \tag{4}$$

where X, Y and Z represent the known standard colour values according to CIE. These are related to the co-ordinates u' and v' of the "CIE 1976 colour table" through the equations $$u' = \frac{4X}{X + 15Y + 3Z} \text{ and} \tag{5}$$

$$v' = \frac{6Y}{X + 15Y + 3Z} \tag{6}$$

This colour table is a colour table in which the colour distances correspond at least approximately to the geometrical distances between the corresponding colour locations in the colour table. The CIE 1976 colour table, more generally formulated, is an "equidistant" colour type table, also called the CIE UCS colour table (UCS: uniform chromaticity scale diagram; CIE 1976).

It should be pointed out here that the CIE 1976 colour table is not the only possible equidistant colour table or colour metric. Within the scope of the invention, in principle any other equidistant colour representation can be used analogously. In the embodiment given here, therefore, the CIE 1976 colour table is chosen purely as an example.

Using the above equations, therefore, a first colour location $(u'_1, v'_1)$ of the CIE 1976 colour table is computed, this colour location describing the colour of the black body radiation at temperature $T_1$, and similarly a second colour location $(u'_2, v'_2)$ for temperature $T_2$.

Then, in a further step, the colour distance d between the first and second colour locations is calculated. Since this colour distance d is at least approximately proportional to the geometrical distance between these two colour locations as represented in the CIE 1976 colour table, it can be calculated as follows from $u'_{1,2}$ and $v'_{1,2}$:

$$d=\sqrt{(u'_1-u'_2)^2+(v'_1-v'_2)^2} \tag{7}$$

The co-ordinates u' and v' can be expressed as functions of the temperature T; the function v'(u'), which results from specifying a series of colour temperature values for T, can also be formed. In this way, the Planckian locus is obtained, in this case for the CIE 1976 colour table. In this way, for colour temperatures T in the range between 1500 K and 10000 K, the result for v'(u') is:

$$v'=500u'^5-875u'^4+610u'^3-212.5u'^2+37.2u'-2.27 \tag{8}$$

Next, the procedure starts from one of the two colour locations, e.g. from the second colour location $(u'_2, v'_2)$, and a third colour location $(u'_3, v'_3)$ is calculated, for which it is the case that it has the colour distance d from the second colour location $(u'_2, v'_2)$ and also lies on the Planckian locus, but differs in the corresponding colour temperature value $T_3$ from the colour temperature value $T_1$ which corresponds to the first colour location $(u'_1, v'_1)$. Because of the quadratic relationship, in general such a colour location is on the Planckian locus. Thus—clearly formulated—in the u'-v' diagram of the CIE 1976 colour table, around the second colour location $(u'_2, v'_2)$, which is on the Planckian locus, a circle with the colour distance d is drawn. In general, this circle intersects the Planckian locus once to the right and once to the left of the centre, that is the colour location $(u'_2, v'_2)$, one intersection point being given by the first colour location $(u'_1, v'_1)$, and the second intersection point representing the third, desired colour location $(u'_3, v'_3)$.

Next, again using the above-mentioned relationships, from the third colour location $(u'_3, v'_3)$, it is possible to deduce the associated colour temperature, called $T_3$ below.

The colour temperature value $T_3$ can thus be called a "colour temperature setpoint value" TS to be determined.

In this way, a series of three colour temperature values $T_1$, $T_2$, $T_3$ has been formed, and it is the case that they correspond to three colours in such a way that between any two adjacent colours on the Planckian locus in the u'-v' diagram, an equal colour distance d is present.

Then, from these three colour temperature values $T_1$, $T_2$, $T_3$, in a way which is known per se, control signals are formed which can be used to control the luminaire 9 so that it generates light with the stated colour temperature values. A series of four or more colour temperature values can be formed in the same way, so that in general an arbitrary range or interval of colour temperatures, and therefore an arbitrarily precise gradation, can be achieved. An example of such a series of seven temperatures $T_1, T_2, T_3, \ldots T_7$ is the colour temperature series 2500 K, 2700 K, 3000 K, 3400 K, 4000 K, 4900 K, 6500 K.

In this way, therefore, it is made possible to provide the possibility of adjusting a corresponding luminaire in stages, so that on moving between the individual stages, the impression of the light changes in at least approximately the same way. Altogether, therefore, compared with the prior art, adjustment can be made significantly easier and faster.

It should be pointed out here that of course the relationships described above can be shortened in practice. Thus, in particular, a direct relationship between the colour temperature T on the one hand and the co-ordinates u' and v' on the other hand can be given. The presentation chosen above was chosen only to make the relationships specially clear.

Below, as a variant, the case is set forth in which, as input quantities 1, only a colour temperature value $T_1$ and a colour distance value d are chosen.

According to the relationships described above, a particular first colour location $(u'_1, v'_1)$ corresponds to the temperature value $T_1$. For instance, for $T_1$=2000 K, the result is the colour location with co-ordinates $u'_1$=0.3050 and $v'_1$=0.3591. Using the permanently specified colour distance d and equations (7) and (8), a second colour location $(u'_2, v'_2)$, which has the colour distance d from the first colour location $(u'_1, v'_1)$, can now be calculated. Then, for this second colour location $(u'_2, v'_2)$, again according to the relationships presented above, the associated colour temperature $T_2$ can be calculated.

Similarly, a further colour temperature value $T_3$, the distance of which from $T_2$ again corresponds to the colour distance d, can now be determined, and so on. Thus by repeated application of these computation steps, a sequence of n colour locations $(u'_1, v'_1)$, $(u'_2, v'_2)$, . . . $(u'_n, v'_n)$, for which it is the case that the perceived colour difference, that is the colour distance d between two successive or adjacent colour locations, is equal in each case, and corresponds to the value d, can again be determined.

Since the co-ordinates u' and v', as shown, are functions of the colour temperature T, a series of colour temperature values $T_1$, $T_2$, . . . $T_n$ can be assigned to this sequence, and therefore it is the case that their corresponding colours each have an equal colour distance d.

With the invention according to the first embodiment presented above, it is made possible, for a luminaire with which light of different colour temperatures can be generated, to provide the possibility of adjustment in stages, so that on moving between the individual stages, the impression that the light communicates to an observer changes at least approximately evenly, that is proportionally to the stages. Altogether, therefore, compared with the prior art, adjustment can be made significantly easier and faster, that is more convenient.

The second embodiment of this invention concerns the control of a luminaire 9 that can radiate light in different colours. Below, only the differences compared with the first embodiment, which is presented above, are discussed. The lighting system with which a method according to the second embodiment can be carried out corresponds—unless otherwise indicated below—to the system shown in FIG. 1, where the three lamps 6, 7, 8 can generate light in three different colours. As established above, in this case, with the luminaire 9, light can be generated with a colour which in a corresponding co-ordinate system, in particular a colour diagram, is identified or represented within a triangle by a colour location, the triangle being spanned by the three colour locations which correspond to the colours of the three lamps 6, 7, 8.

Using the controller 2, therefore, it is possible to generate control signals with which the luminaire 9 can be controlled so that it generates light of a particular colour, which can be identified by a particular colour location in a colour diagram.

Furthermore, in contrast to the first embodiment, the input quantities 1 can now be, in particular, colour locations $F_1$, $F_2$ and/or a colour distance d. The control device includes a computation unit, with which a series of at least three colour locations $F_1, F_2, F_3$ can be calculated. The computation unit is also designed to determine, as output quantities, control signals which are suitable for controlling at least one luminaire 9, in such a way that it generates light of three different colours, corresponding to the three different colour locations $F_1, F_2, F_3$.

Figure 3:
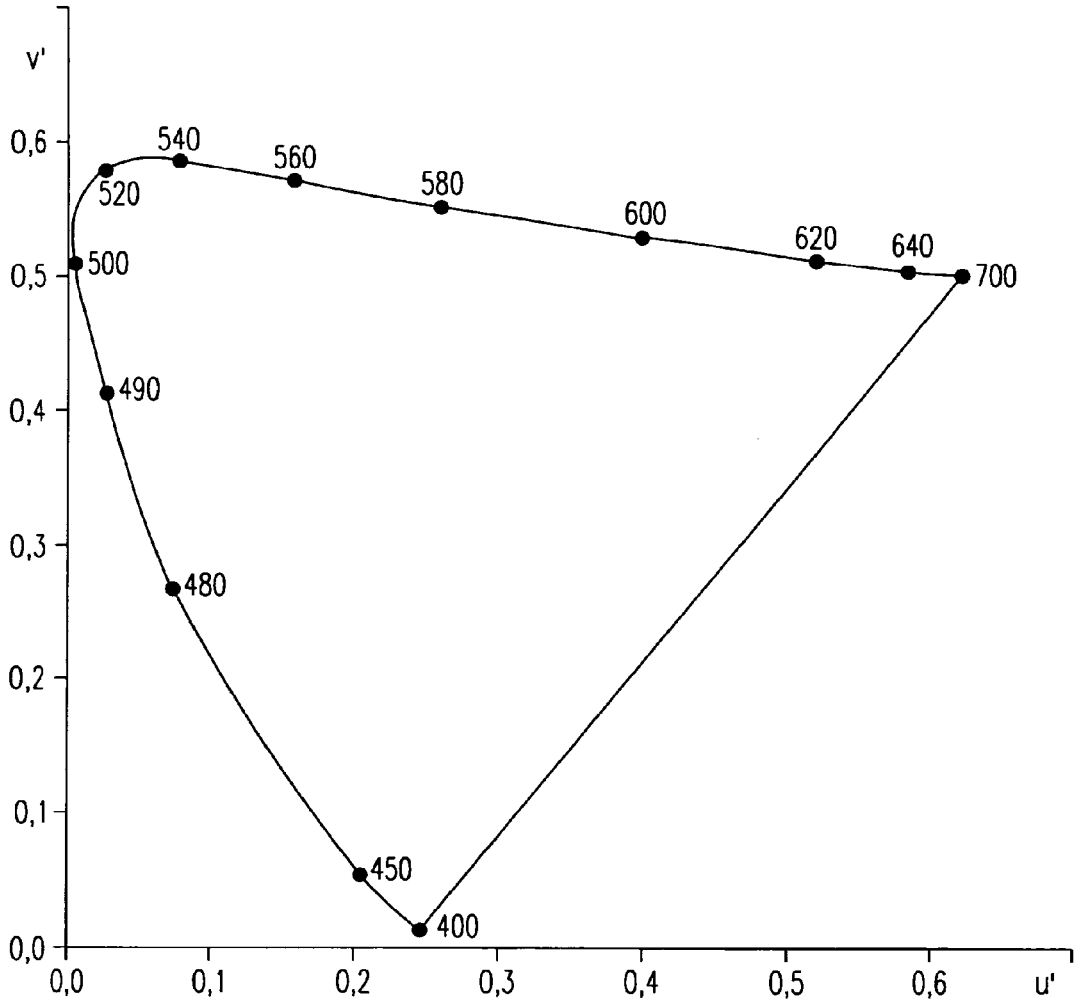
FIG. 3 shows a simplified representation of the CIE 1976 colour table.

The starting point for this second embodiment is a colour change curve K1, which in principle can be freely chosen, between two colour locations $F_A$ and $F_E$. This is drawn schematically in FIG. 4, in which, as in FIG. 3, a simplified representation of the CIE 1976 colour table is sketched. The two colour locations $F_A$ and $F_E$ are within a colour triangle D, which as corner points has three colour locations corresponding to the three colours of the three lamps 6, 7, 8. It should be pointed out that in the representation of FIG. 4, these three corner points are only sketched in principle, and do not necessarily correspond to colour locations for the corresponding colours of which a corresponding lamp actually exists in each case.

According to this embodiment, the colour change curve K1 is chosen to be a straight line. Therefore, depending on the position of the colour locations $F_A$ and $F_E$, the colour change curve K1 in each case can be given either as v' depending on u', or as u' depending on v', in the mathematical sense. The corresponding mathematical function then allows a unique description of all colour locations which lie on K1.

Now, as the starting point, two colour locations $F_1$ and $F_2$, which are on the colour change curve K1 and identify two different (according to the invention) colours, are chosen. For instance, $F_A$ or $F_E$ can be chosen as $F_1$. Then, taking account of the two following conditions, a—generally formulated "further" colour location $F_X$—here therefore a "third" colour location $F_3$ is determined. The first condition is that the third colour location $F_3$ is on the colour change curve K1. The second condition is that the colour distance d between $F_1$ and $F_2$ equals the colour distance between $F_2$ and $F_3$. In this way, therefore, a series of three colour locations is defined, for the three corresponding colours of which it is the case that between any two adjacent colours according to the colour change curve K1, at least approximately an equal colour distance d is present.

Figure 4:
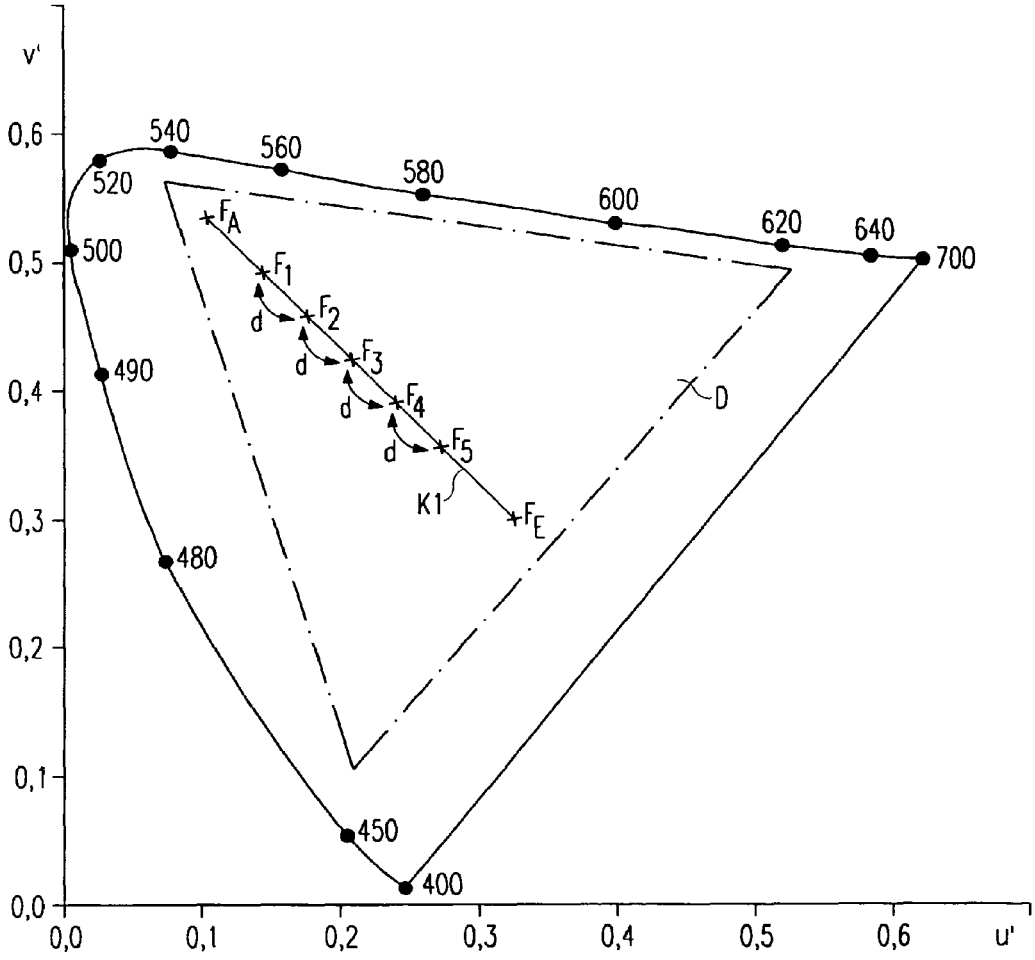
FIG. 4 shows a representation corresponding to FIG. 3, with a "colour change curve"

Purely as an example, in FIG. 4 a case is drawn in which five colour locations $F_1$ to $F_5$, with equal colour distances d in each case, are formed as a series of colour locations. Formulated in general mathematical terms, therefore, a series $<F_i>$ of i colour locations, with $i \in \aleph$, can be formed.

Similarly to the second variant stated in the first embodiment, this series of colour locations can again be defined on the basis (only) of a predetermined colour location (e.g. $F_1$) and a predetermined colour distance d.

In principle, the colour change curve can be of any shape. In particular, therefore, a line which has at least one curved or "kinked" section can be chosen. For the calculation, it is the case that in this case too, depending on the position of the colour locations $F_A$ and $F_E$, the colour change curve, in every case, can be described with sufficient precision in the mathematical sense by a function v'(u') or u'(v'), or if necessary by a function which is put together in sections from the two above-mentioned functions.

According to another example, the colour change curve comprises two sections which are both straight lines, and which enclose a non-zero angle and are connected to each other at an end of each. The connecting point is at the white point or in the "white area" (as defined above). The other end points of the two sections, i.e. using the above terminology the end points $F_A$ and $F_E$, are at two colour locations which each identify a predetermined colour. It is thus possible to control a corresponding luminaire in such a way that—starting from light of a predetermined colour, the colour is changed in equal steps until a "white" light results, and in the further course this white light is changed, again at equal intervals, into light of a second colour.

Figure 5:
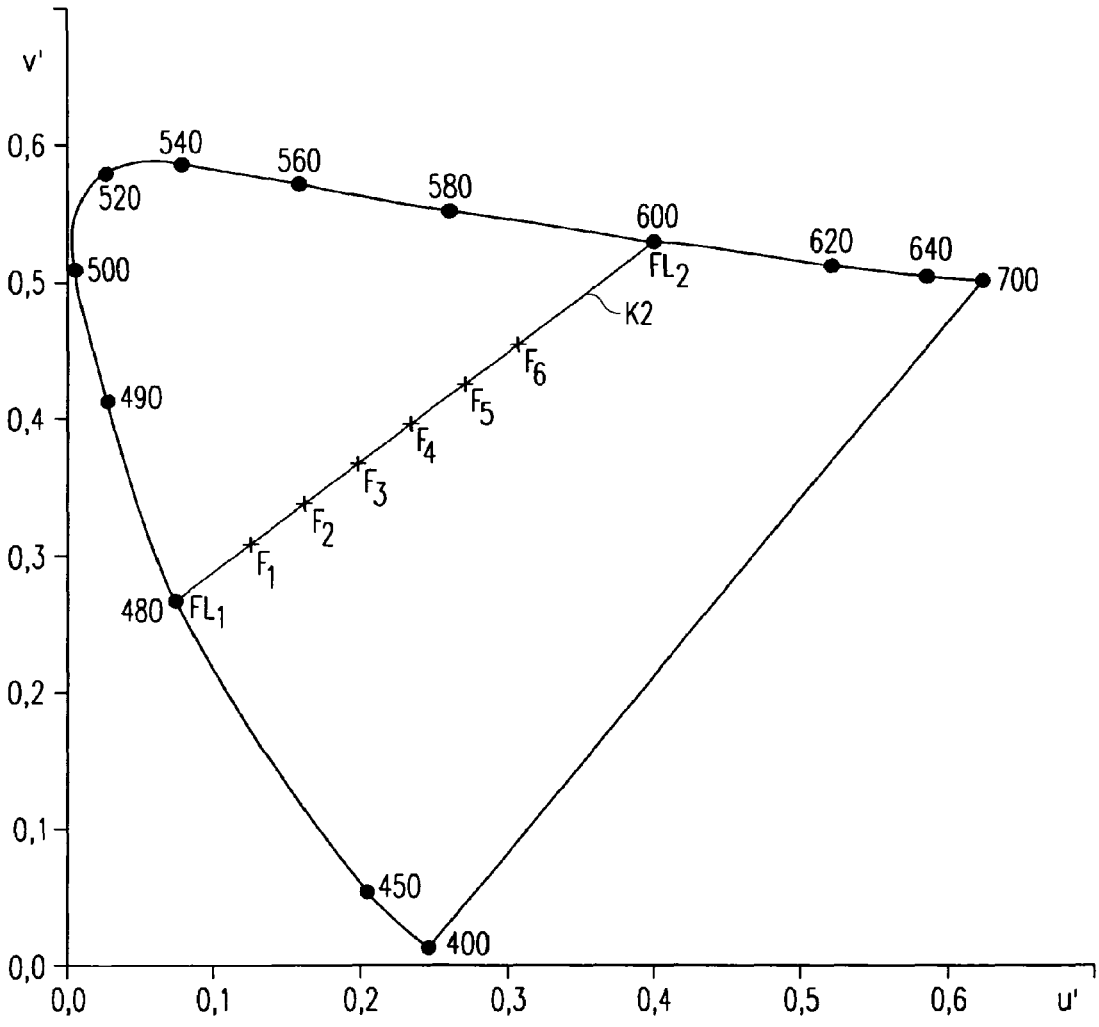
FIG. 5 shows a representation corresponding to FIG. 3, with another "colour change curve".

According to a third embodiment, it is provided that as the colour change curve again a straight line is chosen, but it connects two colour locations, the corresponding colours of which can be formed by light of one lamp each. In the representation of FIG. 5, these two colour locations are designated $FL_1$ and $FL_2$, and the corresponding colour change curve as K2. Otherwise, the computation procedure corresponds to the previous embodiment. It should be noted that in this case a luminaire 9 which has only two lamps, which can emit light in colours corresponding to the colour locations $FL_1$ and $FL_2$, can be provided. In the stated example of the colour change curve K2, for instance, the first lamp can be a LED which radiates light of wavelength 480 nm, and the second lamp can be a LED which radiates light of wavelength 600 nm.

For all the above embodiments, a preferred possibility regarding the time control of the luminaire 9 is that the colour locations $F_1, F_2, F_3, \ldots$ of the series $<F_i>$ are run through at least approximately equal time intervals. In this way, it can be achieved that with only one operating movement to operate the controller, the corresponding light series is generated or run through. In this case, it is unnecessary to initiate each individual colour step individually. This makes control even more convenient. It is also advantageous in this case if the controller is designed so that in addition the time interval between the individual colour stages can be specified.

With the invention, it is made possible, for a luminaire with which light of different colours or colour temperatures can be generated, to provide the possibility of adjustment in stages, so that on moving between the individual stages, the impression that the light communicates to an observer changes at least approximately evenly, that is proportionally to the stages. Altogether, therefore, compared with the prior art, adjustment can be made significantly easier and faster, that is more convenient.

The invention claimed is:

1. A method of providing control signals for a luminaire which can radiate light in different colours, having the following steps:

a1) input of input quantities into an input unit of a control device, comprising a computation unit for determining a series of at least three colour locations, which identify three different colours, depending on the input quantities, the colour locations being chosen so that in a coordinate system which represents the latter, they are at least approximately on a specified colour change curve, and that between any two colours which are adjacent according to the colour change curve, at least approximately equally great colour distances are present, and for determining, for the luminaire, control signals using which the luminaire can be caused to radiate light in the at least three colours, and a transmission unit for transmitting the control signals to the luminaire, wherein the input quantities are two colour locations which differ from each other, and wherein the first colour location identifies a first colour and the second colour location identifies a second colour which differs from the first colour, a2) depending on the first colour location and the second colour location—subject to the two conditions i) and ii)

below—a colour location which is to be determined, and which identifies a further colour, is determined:

i) the colour location to be determined, in the co-ordinate system, together with the first and the second colour location, is at least approximately on a specified colour change curve, and ii) the colour distance between the first and the second colour, or an integer multiple of this colour distance, at least approximately equals the colour distance between the first and the further colour or between the second and the further colour, and b) on the basis of the determined colour location, a control signal which causes the luminaire to radiate light in the further colour corresponding to the determined colour location is generated.

2. A method according to claim 1, wherein the specified colour change curve is the Planckian locus.

3. A method according to claim 1, wherein the luminaire comprises three lamps, preferably LEDs or fluorescent lamps, which can emit light of different colours.

4. A method according to claim 1, wherein the specified colour change curve is a straight line.

5. A method according to claim 4, wherein the luminaire comprises at least two lamps, preferably LEDs or fluorescent lamps, which can emit light of different colours.

6. A method according to claim 1, wherein in a step, a series of at least three colour locations is defined, such that, for their three corresponding colours, between any two colours which are adjacent according to the colour change curve, at least approximately an equally great colour distance is present.

7. A method according to claim 6, wherein the luminaire is controlled temporally so that the at least approximately equally great colour distances are passed through at essentially equal time intervals.

8. A method according to claim 1, wherein, as the co-ordinate system, a co-ordinate system is chosen in which a geometrical distance between two colour locations at least approximately represents a measure for a specified colour distance.

9. A method according to claim 1, wherein the representation of the CIE 1976 colour table is chosen as the co-ordinate system.

10. A method of providing control signals for a luminaire which can radiate light in different colours, having the following steps:

a1) input of input quantities into an input unit of a control device, comprising a computation unit for determining a series of at least three colour locations, which identify three different colours, depending on the input quantities, the colour locations being chosen so that in a co-ordinate system which represents the latter, they are at least approximately on a specified colour change curve, and that between any two colours which are adjacent according to the colour change curve, at least approximately equally great colour distances are present, and for determining, for the luminaire, control signals using which the luminaire can be caused to radiate light in the at least three colours, and a transmission unit for transmitting the control signals to the luminaire, wherein the input quantities are one colour location and one colour distance, and wherein the first colour location identifies a first colour, a2) depending on the colour location and the colour distance—subject to the two conditions i) and ii) below—a colour location which is to be determined, and which identifies a further colour, is determined:

i) the colour location to be determined, in the co-ordinate system , together with the first colour location, is at least approximately on a specified colour change curve, and ii) the colour distance between the first and the further colour, at least approximately equals the specified colour distance or an integer multiple of it, and b) on the basis of the determined colour location, a control signal which causes the luminaire to radiate light in the further colour corresponding to the determined colour location is generated.

11. A method of providing control signals for a luminaire whose colour temperature is changeable, having the following steps:

input of input quantities into an input unit of a control device, comprising a computation unit to determine a series of at least three colour temperature values, depending on the input quantities, the colour temperature values being chosen so that they correspond to three colours in such a way that between any two adjacent colours, at least approximately equally great colour distances are present, and to determine, for the luminaire, control signals using which the luminaire can be caused to radiate light with the at least three colour temperature values, and a transmission unit to transmit the control signals to the luminaire, wherein the input quantities are two colour temperature values which differ from each other, and determination of a colour temperature setpoint value depending on the two colour temperature values, the colour temperature setpoint value being chosen so that the colour distance between the two colours, which correspond to the specified colour temperature values, or an integer multiple of this colour distance, at least approximately equals the colour distance between the colour which corresponds to one of the two specified colour temperature values and the colour which corresponds to the colour temperature setpoint value to be determined.

12. A method of providing control signals for a luminaire whose colour temperature is changeable, having the following steps:

input of input quantities into an input unit of a control device, comprising a computation unit to determine a series of at least three colour temperature values, depending on the input quantities, the colour temperature values being chosen so that they correspond to three colours in such a way that between any two adjacent colours, at least approximately equally great colour distances are present, and to determine, for the luminaire, control signals using which the luminaire can be caused to radiate light with the at least three colour temperature values, and a transmission unit to transmit the control signals to the luminaire wherein the input quantities are one colour temperature value and one colour distance, and determination of a colour temperature setpoint value depending on the colour temperature value and the colour distance, the colour temperature setpoint value being chosen so that the colour distance between the colour which corresponds to the specified colour temperature value and the colour which corresponds to the colour temperature setpoint value to be determined at least approximately equals the specified colour distance or an integer multiple of the specified colour distance.

13. A method according to claim 11, wherein the luminaire comprises three lamps, which can emit light of different colours.

14. A method according to claim 13, wherein the three lamps are LEDs or fluorescent lamps.

15. A method according to claim 11, wherein, in a further step, a series of at least three colour temperature values is defined, such that, for their three corresponding colours, between any two adjacent colours at least approximately an equally great colour distance is present.

16. A method according to claim 11, wherein to determine the relationship between two colour temperature values and the colour distance between the two colours corresponding to the two colour temperature values, with the aid of Planck's radiation law and the sensitivities of the human eye to red, green and blue light, a co-ordinate system in which a geometrical distance between two colour locations at least approximately represents a measure of a specified colour distance is used.

17. A method according to claim 16, wherein the representation of the CIE 1976 colour table is chosen as the co-ordinate system.

* * * * *